United States Patent [19]

Stanich

[11] Patent Number: 4,555,920

[45] Date of Patent: Dec. 3, 1985

[54] PADLOCK COVER

[76] Inventor: Judith A. Stanich, 1500 S. Ocean Dr., Apt. #1103, Pompano Beach, Fla. 33072

[21] Appl. No.: 618,685

[22] Filed: Jun. 8, 1984

Related U.S. Application Data

[63] Continuation-in-part of Ser. No. 554,903, Nov. 25, 1983, Pat. No. 4,534,190.

[51] Int. Cl.[4] ..... E05B 67/38

[52] U.S. Cl. ..... 70/54; 70/56

[58] Field of Search ..... 70/54, 55, 56, 14, 51, 70/417, 20; 150/52

[56] References Cited

U.S. PATENT DOCUMENTS 4,300,370 11/1981 Kaiser ..... 70/54

FOREIGN PATENT DOCUMENTS 400959 8/1924 Fed. Rep. of Germany ..... 70/55

1365684 9/1974 United Kingdom ..... 70/54

*Primary Examiner*—Robert L. Wolfe

*Attorney, Agent, or Firm*—Oltman and Flynn

[57] ABSTRACT

A padlock cover molded in one rigid piece and open at the back. The cover has a cylindrical inner wall for holding the body of a padlock, an outer side wall spaced laterally outward from the inner wall, and a front wall extending from the outer side wall laterally inward to the inner wall and slightly past it at the top. At the top on one side the inner wall and the outer side wall have vertically aligned openings for passing one leg of the usual inverted U-shaped shackle of the padlock. At the top on the opposite side the inner wall and the outer side wall have vertically aligned slots which are open at the back to pass the opposite leg of the padlock shackle.

6 Claims, 6 Drawing Figures

PADLOCK COVER

CROSS-REFERENCE TO RELATED APPLICATION

This invention is a continuation-in-part of the invention disclosed in my U.S. patent application Ser. No. 554,903, filed Nov. 25, 1983, and now U.S. Pat. No. 4,534,190.

SUMMARY OF THE INVENTION

This invention relates to a cover for a padlock.

One widely used type of padlock has a cylindrical body containing a combination lock operated by a rotatable knob on the front, and an inverted U-shaped shackle extending up from the body of the lock. Such locks are starkly utilitarian in appearance. The present invention is directed to a novel cover for attachment to such a lock to improve and individualize its appearance, making it readily identifiable from similar locks, such as in a row of lockers, as well as to proctect the lock against damage from the outside.

The present cover is a one-piece, molded body, perferably of relatively rigid and hard plastic, which can be assembled on or removed from a padlock relatively easily when the lock is open but cannot be removed when the lock is closed except by damaging the cover itself. This inhibits a person from stealing the cover from another's padlock.

A principal object of this invention is to provide a novel cover for attachment to a padlock to improve its appearance and make it more readily distinguishable from other padlocks nearby.

Another object of this invention is to provide such a cover which is attachable to or removable from a padlock when it is open but is not removable when the lock is closed except by damaging the cover does not interfere with the usual operation of the padlock when the cover is in place.

Further objects and advantages of this invention will be apparent from the following detailed description of presently preferred embodiment which is illustrated schematically in the accompanying drawing.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
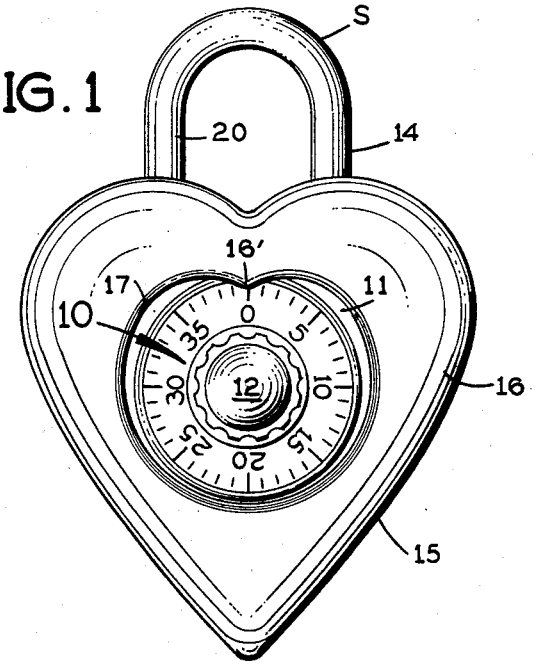
FIG. 1 is a front elevational view of the cover of this invention in place on a padlock of conventional design.
Figure 2:
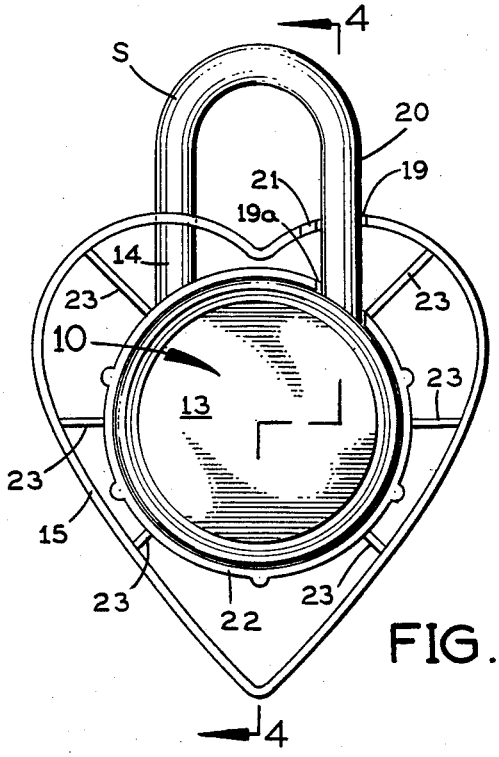
FIG. 2 is a rear elevation of the padlock and cover assembly shown in FIG. 1.

Referring first to FIGS. 1 and 2, a padlock of known design is shown as having a cylindrical body 10 with a front end face 11 where a rotatable knob 12 is located and a back end face 13 (FIG. 2). The knob 12 operates a combination lock mechanism inside the body of the padlock in the usual manner. At the top the padlock has the usual rigid reciprocable and rotatable shackle S of inverted U-shape which is down (as shown) when the lock is closed and is displaceable upward with respect to the padlock body when the lock is open. When the lock is open, the padlock body may be rotated about one vertical leg 14 of the shackle, or vice versa, from the locking position of FIG. 3 to the released position of FIG. 5.

The present cover is a substantially rigid, one-piece, molded body of suitable plastic material having a heart-shaped outer side wall 15, and a slightly rounded/convex, front wall 16 extending laterally inward from the outer side wall 15 to a central opening 17. At the top of opening 17 the front wall 16 of the cover presents a downwardly projecting central lip 16′ which extends directly in front of the front end face 11 of the padlock body. Throughout its extent the edge of the opening 17 is a substantial distance radially outward from the knob 12 of the padlock so that it does not impede the user's fingers when he or she grasps the knob and turns it.

Figure 3:
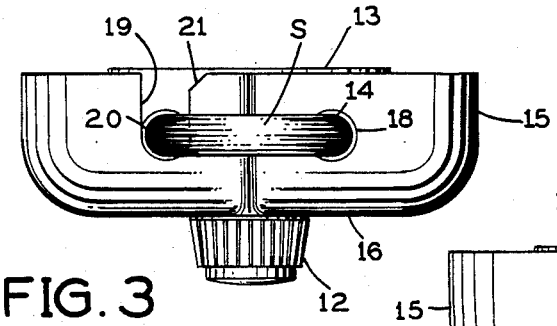
FIG. 3 is a top plan view of the padlock and cover assembly with the shackle of the padlock in its closing position.
Figure 5:
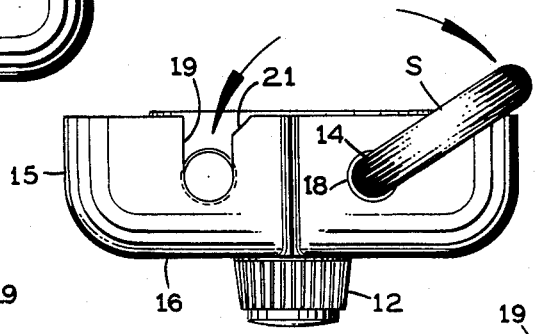
FIG. 5 is a top plan view of the padlock and cover assembly with the shackle of the padlock open and rotated from its closing position.

At the top on one side the outer side wall 15 of the cover presents a circular opening 18 (FIG. 6) which rotatably and slidably receives the leg 14 of the padlock shackle S, as shown in FIGS. 3 and 5. At the top on the opposite side the outer side wall 15 of the cover presents a slot 9 which is open at the back of the cover and has a rounded, closed front end. This slot slidably receives the opposite vertical leg 20 of the padlock shackle S. Slot 19 has a chamfered edge 21 on its inner side at the back of the cover to facilitate the movement of shackle leg 20 into or out of this slot when the shackle is rotated on its opposite leg 14.

Figure 6:
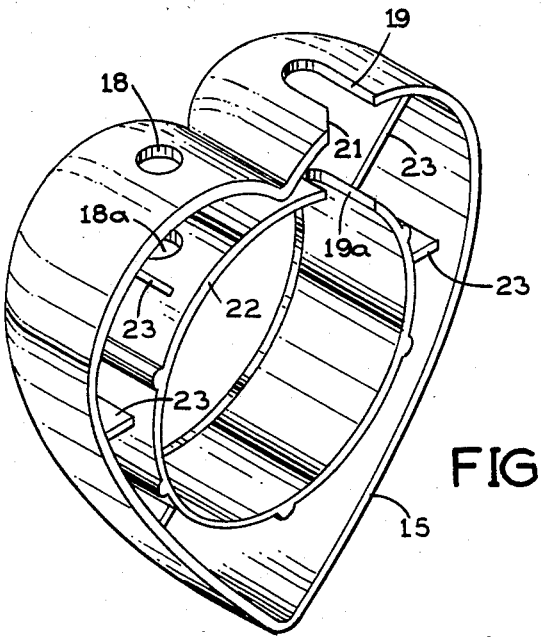
FIG. 6 is a rear perspective view of the present padlock cover.

The present cover has a cylindrical inner wall 22 spaced laterally inward from its outer wall 15 and joined to the outer wall by lateral ribs 23 extending between them, as shown in FIGS. 2 and 6. The cylindrical inside surface of inner wall 22 is substantially complementary to the cylindrical side wall of the padlock body 10, so that the padlock body is slidably but snugly received inside the inner side wall 22 of the cover, as shown in FIG. 2. At the lip 16′(FIG. 1) and on opposite sides of it along the top of the front opening 17, the front wall 16 of the cover extends laterally inward past the inner wall 22 to engage the front of the padlock body.

At the top on one side the inner side wall 22 has an opening 18*a* (FIG. 6) which is spaced below, and vertically aligned with, the opening 18 in the outer side wall 15. At the top on the opposite side the inner side wall 22 has a slot 19*a* (FIGS. 4 and 6) which is spaced below, and vertically aligned with, the slot 19 in the outer side wall 15 and is the same size and shape as the latter, looking down on the cover from above it. The inner side wall opening 18*a* slidably and rotatably receives the padlock shackle leg 14, and the slot 19*a* slidably passes the opposite leg 20 of the shackle.

Figure 4:
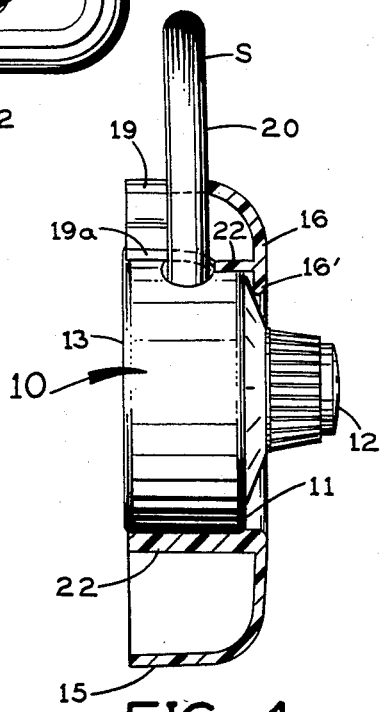
FIG. 4 is a vertical section taken along the line 4—4 in FIG. 2.

With the shackle S in an open position, the padlock 10 may be placed inside the present cover by positioning the padlock body behind the cover and sliding the free end of shackle leg 20 through opening 18*a* in the inner side wall 22 of the cover and then out through the aligned opening 18 in the outer side wall 15 of the cover, and then pushing the rest of the shackle through these openings until the opposite shackle leg 14 is in these openings and the padlock body is seated inside the inner side wall 22 of the cover, with the rotatable knob 12 of the padlock in front of the cover, as shown in FIG. 4. The shackle may be rotated from its released or unlocked position (FIG. 5) to the locking position (FIG. 3) in which its leg 10 may be pushed into the padlock body for locking engagement with the locking mechanism therein.

When the padlock is closed, the present cover cannot be removed from it because of the engagement of the shackle leg 14 in the openings 18 and 18*a* in the cover. This effectively prevents any removal of the cover by a person who does not know the combination to open the lock. When the lock is open, the present cover may be mounted on it or removed from it without great difficulty. Ordinarily, however, the owner will keep the cover on as long as the lock is in use since it provides physical protection for the lock, as well as identifying it to the owner and improving its appearance.

I claim:

1. For use on a padlock having a body with a lock mechanism therein and an inverted U-shaped shackle above said body with laterally spaced, opposite, straight legs, one of which is rotatably and slidably received in said body and the other of which is slidably reciprocable into and out of said body for locking engagement with said lock mechanism therein and removal from said body when released from locking engagement with said lock mechanism, a cover for said padlock having:

a recess for receiving the padlock body;

a top opening above said recess on one side for rotatably and slidably receiving said one leg of the shackle, said cover surrounding said opening to prevent removal of the padlock from the cover except by sliding the shackle longitudinally through said opening in the cover;

and a slot above said recess opposite said top opening for passing said other leg of the shackle reciprocably into and out of said body of the padlock, said slot being open at one end to pass said other leg of the shackle when the shackle is rotated on said one leg after removal of said other leg from the body of the padlock.

2. A padlock cover according to claim 1 and molded in a piece as a substantially rigid structure.

3. A padlock cover according to claim 1 and having:

a front wall with an opening therein leading into said recess for receiving the padlock body;

an outer sidewall extending rearward from said front wall along the periphery of said front wall, said outer side wall having said opening and said slot therein, said slot having its open end at the back edge of said outer side wall;

and an annular inner wall extending rearward from said front wall and spaced laterally inward from said outer side wall, said inner wall defining said recess and having a top opening which is verticall aligned with said opening in the outer side wall to receive said one leg of the padlock shackle and having a slot in the top which is vertically aligned with said slot in the outer side wall and is open at the back edge of said inner wall to pass said other leg of the padlock shackle;

said cover being open at the back between said slots in the outer side wall and the inner wall to pass said other leg of the padlock shackle.

4. A padlock cover according to claim 3 wherein:

said cover is open at the back of said recess for the slidable insertion of the padlock body into said recess from behind the cover.

5. A padlock cover according to claim 4 wherein:

said front wall extends laterally inward past said inner all part way around the front end of the latter for engagement by the front of the padlock body.

6. A padlock cover according to claim 5 which is a rigid, one-piece, molded plastic structure.

* * * * *